US006196430B1

(12) United States Patent
Gouldson

(10) Patent No.: US 6,196,430 B1
(45) Date of Patent: Mar. 6, 2001

(54) GARMENT HANGER

(75) Inventor: Stanley F. Gouldson, Northport, NY (US)

(73) Assignee: Spotless Plastics Pty. Ltd., Moorabbin (AU)

( * ) Notice: Subject to any disclaimer, the term of this patent is extended or adjusted under 35 U.S.C. 154(b) by 0 days.

(21) Appl. No.: 08/867,986

(22) Filed: Jun. 3, 1997

Related U.S. Application Data

(63) Continuation of application No. 08/675,228, filed on Jul. 1, 1996, now abandoned, which is a continuation-in-part of application No. 29/054,319, filed on May 9, 1996.

(51) Int. Cl.[7] ..... A47G 25/48

(52) U.S. Cl. ..... 223/96; 223/91

(58) Field of Search ..... 223/85, 88, 91, 223/93, 96, 92, 95

(56) References Cited

U.S. PATENT DOCUMENTS

| | | |
|---|---|---|
| D. 33,665 | 12/1900 | Kramer . |
| 119,938 | 10/1871 | Mellish . |
| D. 122,692 | 9/1940 | Owen . |
| 143,024 | 9/1873 | Mellish . |
| D. 159,252 | 7/1950 | Cook . |
| D. 167,986 | 10/1952 | Jonaitis . |
| D. 194,726 | 2/1963 | Allen . |
| D. 196,469 | 10/1963 | Kennedy . |
| D. 204,134 | 3/1966 | Duncan . |
| D. 214,968 | 8/1969 | Field et al. . |
| D. 219,488 | 12/1970 | Schayer . |
| D. 236,572 | 9/1975 | Ostroll . |
| D. 244,197 | 5/1977 | Ostroll . |
| D. 246,817 | 1/1978 | Mainetti . |

(List continued on next page.)

FOREIGN PATENT DOCUMENTS

| | | |
|---|---|---|
| 401137 | 9/1966 | (AU) . |
| 1775341 | 6/1958 | (DE) . |
| 7613691 | 10/1976 | (DE) . |
| 7636729 | 3/1977 | (DE) . |
| 974290 | 10/1918 | (FR) . |
| 1424774 | 2/1965 | (FR) . |
| 910375 | 10/1959 | (GB) . |
| 1155472 | 4/1967 | (GB) . |
| 1514978 | 12/1975 | (GB) . |
| 2069332 | 2/1980 | (GB) . |
| 2058192 | 7/1980 | (GB) . |

*Primary Examiner*—Bibhu Mohanty
(74) *Attorney, Agent, or Firm*—Scully, Scott, Murphy & Presser

(57) ABSTRACT

A molded plastic garment hanger as is widely used for the purpose of shipping and displaying garments, comprising a unitary plastic central hook and arms extending in opposite directions from the base of the central hook to facilitate a garment to be suspended therefrom by garment clips. The garment clips enable the attachment of various kinds of garments thereto, such as underwear, slips, brassieres, swimwear, multiple garments, and the like. The garment hanger has an improved garment retaining clip wherein as a garment is inserted into the garment retaining clip, the garment receiving channel of the clip first opens to allow the garment to enter, and then closes to securely retain the garment and to prevent it from becoming accidentally dislodged therefrom. The garment hanger also has an improved panty retaining clip having an inward slant defined by a receiving channel of the panty retaining clip. As a panty waist band is inserted fully into the panty retaining clip, the panty waist band moves radially inwardly towards the center of the garment hanger, which means that after a panty waist band is inserted fully into the panty retaining clip, the panty waist band shrinks at each end of the garment hanger. Accordingly, the panty waist band must be expanded or stretched at each end of the garment hanger to remove the panty from the panty retaining clip, which makes accidental dislodgement of the garment from the garment clip a virtual impossibility.

39 Claims, 4 Drawing Sheets

U.S. PATENT DOCUMENTS

| | | | | |
|---|---|---|---|---|
| D. 258,336 | | 2/1981 | Vacoe . | |
| D. 264,912 | | 6/1982 | Bliss et al. . | |
| 491,062 | | 1/1893 | Granger . | |
| 517,120 | | 1/1899 | Skinner . | |
| 697,103 | | 4/1902 | Pickhardt . | |
| 723,587 | | 3/1903 | Cowles . | |
| 769,694 | | 9/1904 | Geisert . | |
| 1,315,823 | | 2/1919 | Dugan . | |
| 1,447,083 | | 2/1923 | Jonas . | |
| 1,605,918 | | 11/1926 | Buchanan . | |
| 2,095,900 | | 10/1937 | Albert . | |
| 2,107,026 | | 2/1938 | Coney . | |
| 2,145,120 | | 1/1939 | Loveless . | |
| 2,171,680 | | 1/1939 | Baugh . | |
| 2,318,084 | | 5/1943 | LaPorte . | |
| 2,393,632 | | 1/1946 | Hartz . | |
| 2,401,413 | | 6/1946 | Colwell . | |
| 2,419,723 | | 4/1947 | Mack . | |
| 2,421,307 | | 1/1947 | Albrecht . | |
| 2,471,141 | | 5/1949 | Castelli . | |
| 2,492,287 | | 12/1949 | Hogan . | |
| 2,620,103 | | 11/1952 | Antolini . | |
| 2,723,787 | | 11/1955 | Bransdorf . | |
| 2,908,431 | | 10/1959 | Campbell . | |
| 3,028,974 | | 4/1962 | Loeb . | |
| 3,041,696 | | 12/1962 | Ferri . | |
| 3,076,242 | | 2/1963 | Priolo . | |
| 3,209,966 | | 10/1965 | Wach . | |
| 3,225,977 | | 12/1965 | Gandy . | |
| 3,327,912 | | 6/1967 | Blair . | |
| 3,405,429 | | 10/1968 | Vasquez . | |
| 3,463,369 | | 8/1969 | Moskowitz . | |
| 3,464,605 | | 9/1969 | Apel . | |
| 3,524,226 | | 8/1970 | Brown . | |
| 3,570,729 | | 3/1971 | Zuckerman . | |
| 3,738,549 | | 6/1973 | Driscoll . | |
| 4,132,316 | | 1/1979 | Schmidt . | |
| 4,148,421 | | 4/1979 | Levitt . | |
| 4,623,079 | * | 11/1986 | Tendrup et al. | 223/85 |
| 4,629,102 | | 12/1986 | Tendrup et al. . | |
| 4,714,183 | | 12/1987 | Tontarelli . | |
| 4,828,155 | * | 5/1989 | Louw | 223/85 |
| 4,892,237 | * | 1/1990 | Duester et al. | 223/85 |
| 4,951,855 | | 8/1990 | Jacobson et al. . | |
| 5,002,210 | * | 3/1991 | Kolton et al. | 223/91 |
| 5,062,556 | * | 11/1991 | Willputz | 223/91 |
| 5,065,916 | * | 11/1991 | Fildan | 223/91 |
| 5,127,559 | | 7/1992 | Freer et al. . | |
| 5,129,557 | | 7/1992 | Kolton et al. . | |
| 5,236,109 | * | 8/1993 | Zuckerman | 223/96 |
| 5,411,189 | * | 5/1995 | Gouldson | 223/91 |
| 5,509,587 | | 4/1996 | Gouldson et al. . | |
| 5,516,013 | | 5/1996 | Gouldson et al. . | |
| 5,632,423 | | 5/1997 | Louw . | |

* cited by examiner

GARMENT HANGER

This application is a continuation of application Ser. No. 08/675,228 filed Jul. 1, 1996, now abandoned, which is a continuation-in-part of U.S. Ser. No. 29/054,319, filed May 9, 1996.

BACKGROUND OF THE INVENTION

1. Field of the Invention

The present invention relates generally to molded plastic garment hangers as are widely used for the purpose of shipping and displaying garments. Garment hangers of that type may be simply constructed as molded plastic structures incorporating a central hook adapted to be suspended from a suitable support, such as a garment display rack or the like. The garment hanger body typically has arms extending in opposite directions from the base of the central hook so as to facilitate a garment to be suspended therefrom. The opposite or distal ends of the arm typically have garment clips formed thereon to enable the attachment of various kinds of garments thereto, such as underwear, slips, brassieres, swimwear, multiple garments, and the like.

2. Discussion of the Prior Art

A wide variety of such garment hangers are presently known. Typically, such garment hangers have a hook portion elevated above a horizontally-extending body portion, as shown in U.S. Pat. No. Des. 246,817. In order to grasp a garment effectively, clips, grips, slots or hooks (collectively referred to herein as "clips") are placed at the ends of the body portion of the hanger. Such prior art hangers are exemplified by U.S. Pat. Nos. 4,623,079; 4,629,102; 4,892,237; 5,065,916; and 5,129,557.

U.S. Pat. Nos. 4,623,079 and 4,629,102 disclose a hanger having an elevated hook member, a hanger body having horizontally extending arms and respectively, resilient grips and clips of a U-shaped configuration located at the end of each arm. The U-shaped configuration includes first and second members, which are also being connected to each other; the second member also being connected to the hanger body. The U-shaped garment engaging clip has a double-flex mechanism to prevent breakage of the clip when a garment is resiliently engaged.

U.S. Pat. No. 4,892,237 discloses a plastic garment hanger having a hook, a body bar extending longitudinally from the hook, with the body bar terminating at each end in a pair of arms, one above and one below the body bar which form garment receiving slots. A third arm creates a downwardly opening slot at the end of the body. The shape of the arms is such that the mouth or open end of the slot is narrower than the upper or inner end of each clip. Adjacent the blind end of the garment receiving slot, the slot is deepened to form a pocket which is recessed downwardly into the body. At the entrance of the pocket a tongue from the upper flange of the body bar is provided. The tongue divides the pocket. Additionally, a finger which extends upwardly and outwardly at an angle from the upper flange of the body bar is provided. The finger is spaced inwardly a short distance from the clip.

U.S. Pat. No. 5,065,916 discloses a plastic garment hanger having garment retaining clip ends formed with downwardly and outwardly included support elements from which upper and lower retaining elements extend in a "T" and are provided directly with the formations engaging the garments in respective channels. The channels are defined by a surfaces having interdigitating arrays of teeth. The clip configuration is intended to overcome the deficiencies ordinary associated with clips having flexible bent back finger.

U.S. Pat. No. 5,129,557 discloses a plastic garment hanger having a hook, a body bar extending longitudinally from the hook and wing portions terminating each end of the body bar. Each wing portion defines a second channel in intersecting relation with the first channel. The second channel is inclined at an acute angle with respect to the first channel. Positioned along the first channel are a series of generally semi-circular projections which function to impede the movement of the garment, i.e. panty, intended to be suspended therefrom.

U.S. Pat. No. 5,236,109 discloses a plastic, multi-garment hanger which includes a slot extending upwardly from the edge of the body member between a vertically oriented clip and a horizontally oriented clip. The slot provides for the displacement of a portion of the vertically oriented clip and/or the horizontally oriented clip thereby reducing the level of stress concentrated at the upper, inward edge of vertical oriented clips and the connecting portion of the horizontally oriented clips of the typical multi-clip hangers. However, while the slot is taught to provide additional flexibility, applicant notes that the portions of the vertically oriented and horizontally oriented clips of U.S. Pat. No. 5,236,109 are necessarily thinner in construction which weakens such clips and reduces their strength.

Each of the above-described prior art hangers (with the exception of the hanger provided by U.S. Pat. No. 5,129,557) is provided with a clip arrangement for the retention of light-weight, two-piece garments, such as panties and brassieres. Each type of clip arrangement is provided with some level of flexibility necessary for the insertion of the garment clip.

The clip arrangement of the hanger discloses in U.S. Pat. Nos. 4,623,079 and 4,629,102, described above, has generally a U-shaped configuration, the flexible free end of which can be deflected in two directions.

The clip arrangements of the hanger discloses in U.S. Pat. No. 5,065,916, described above, has a T-shaped clip configuration to firmly engage garments. It will be appreciated that the channel of the vertical clip extends at its upper end into an inwardly extending lateral slot so that a bend is applied to the waistband which can be somewhat stretched to better secure the waistband.

The clip arrangement of the hanger discloses in U.S. Pat. No. 4,892,237, described above, is designed so that the flexible arms forming the garment receiving channels provide a clamping zone to prevent the inadvertent release of the garment retained therein.

A major problem in the prior art with many molded plastic garment hangers is that of breakage of the garment clips formed thereon as a garment is inserted therein or removed therefrom. This problem with breakage of the garment clips has been recognized in the prior art, and the approach taken in the prior art to avoiding or minimizing such breakage has been to design the garment clips with additional strength and stiffness to prevent such breakage. The additional strength and stiffness has often been achieved by designing the moveable arm or arms of the garment clip with a stiffening rib extending longitudinally along the outer length of the moveable arm. Such a longitudinally extending stiffening rib imparts additional strength and stiffness to the moveable arm, but did not solve the problem with breakage of such moveable clip arms as the stiffer, more rigid arm would be forced open with more difficulty by a user, but would still result in breakage of a substantial number of such garment clips.

Moreover with such molded plastic garment hangers, garments are frequently inserted into the garment clips manually by a person who inserts a great number of garments into a corresponding number of garment clips. With the stiffer, more rigid clips, the persons inserting the garments into the garment clips frequently developed carpel tunnel syndrome because of the constant strain associated with inserting a large number of garments, particularly thicker garments, into the garment clips.

SUMMARY OF THE INVENTION

Accordingly, it is a primary object of the present invention to provide garment hangers having improved garment retaining clips at opposite ends thereof which are designed to securely retain a garment to prevent it from being accidentally dislodged therefrom. Moreover, the improved garment retaining clips are designed to avoid breakage of the clips, which is a problem in many prior art garment retaining clips.

Moreover, the improved garment clips are designed with a much greater flexibility, without a stiffening rib extending longitudinally along the outer length of the moveable clip arm. The more flexible clip arm is much easier to open and use, and moreover the greater flexibility also makes the insertion of garments, particularly thicker garments, into the clips much easier, and greatly alleviates problems with carpel tunnel syndrome by persons who are employed to insert a great number of garments into a great number of such garment retaining clips.

A further object of the subject invention is the provision of a garment hanger having an improved garment retaining clip wherein as a garment is inserted into the garment retaining clip, a compound movement and action of first and second support members arranged in a double return configuration result in the garment receiving channel of the clip first opening to allow the garment to enter, and then closing to securely retain the garment therein and to prevent it from becoming accidentally dislodged therefrom.

The garment hanger also has an improved panty retaining clip having an inward slant defined by a receiving channel of the panty retaining clip. As a panty waist band is inserted into the panty retaining clip and is inserted from an initial position at an opening thereof to a fully inserted position, the panty waist band moves radially inwardly towards the center of the garment hanger. Accordingly, after a panty waist band is inserted fully into the panty retaining clip, the panty waist band shrinks at each end of the garment hanger. This also means that the panty waist band must be expanded or stretched at each end of the garment hanger to remove the panty from the panty retaining clip, which makes accidental removal or dislodgement of the garment from the garment clip a virtual impossibility.

In accordance with the teachings herein, the present invention provides a lightweight, molded plastic garment hanger comprising a hook member and a body member extending longitudinally from the hook member. The body member defines first and second opposite ends, and a garment retaining clip is integrally molded with the body member at each of the first and second ends. Each garment retaining clip is positioned adjacent to the body member, and defines a garment receiving channel therebetween. The garment retaining clip defines a compound movement, double return configuration formed by a first member mounted to the end of the body member by a first cantilever mount and having a spaced end, and a second member integrally connected in a spaced relation to the first member by a second cantilever mount and having a spaced free end. As a garment enters the garment receiving channel, an initial expansion at the mouth of the garment receiving channel causes a rotation of the combination of the first and second members about the first cantilever mount. Subsequently as the garment slides past the second cantilever mount, it causes an upward flexure of the free end of the second member about the second cantilever mount and a downward deflection of the spaced end of the first member causing a closing of the second member against the body member. With this arrangement as a garment is inserted into the garment retaining clip, the compound movement and action of the first and second members result in the garment receiving channel of the clip first opening to allow the garment to enter, and then closing to securely retain the garment therein and to prevent it from being accidentally dislodged therefrom.

In greater detail, each of the first and second members defines a rounded rectangular or oval shape having the same width W as the body member to resist movement into and out of the plane defined by the body member.

The present invention also provides a lightweight, molded plastic garment hanger comprising a hook member and a body member extending longitudinally from the hook member. The body member defines first and second opposite ends, and a garment retaining clip is integrally molded with the body member at each of the first and second ends. Each garment retaining clip comprises first and second opposed clip sides defining a garment receiving channel therebetween. The first clip side comprises a first downwardly extending member mounted to the end of the body member by a first cantilever mount and having a spaced end, and a second upwardly extending member integrally connected in spaced relation to the first member by a second cantilever mount and having a spaced free end. The second clip side comprises a downwardly extending member which is positioned opposed to and spaced from the first clip side to define the garment receiving channel therebetween. Pursuant to the present invention, the garment receiving channel defined by the first and second opposed clip sides proceeds from a bottom opening of the garment receiving channel, upwardly and inwardly towards the hook member to a top garment retaining position. The radial difference between the bottom opening and the top garment retaining position is approximately 0.125 inches, such that as a garment is inserted fully into the garment retaining clip, the length of the garment shrinks approximately ⅛" at each end of the garment hanger. This also means that the length of the garment must be expanded or stretched ¼", considering the expansion at both ends, to remove the garment from the garment retaining clip, which deters accidental dislodgement of the garment therefrom.

In greater detail, the first downwardly extending member of the first clip side includes a center stiffening rib extending longitudinally along the outer length of the first downwardly extending member to provide a relatively stiff and inflexible first downwardly extending member. Moreover, the first downwardly extending member of the first clip side further includes a center stiffening rib extending longitudinally along the inner length of the first downwardly extending member to provide a relatively stiff and inflexible first downwardly extending member.

BRIEF DESCRIPTION OF THE DRAWINGS

The foregoing objects and advantages of the present invention for a garment hanger may be more readily understood by one skilled in the art with reference being had to the following detailed description of a preferred embodiment thereof, taken in conjunction with the accompanying drawings wherein like elements are designated by identical reference numerals throughout the several views, and in which.

DETAILED DESCRIPTION OF THE DRAWINGS

Figure 1:
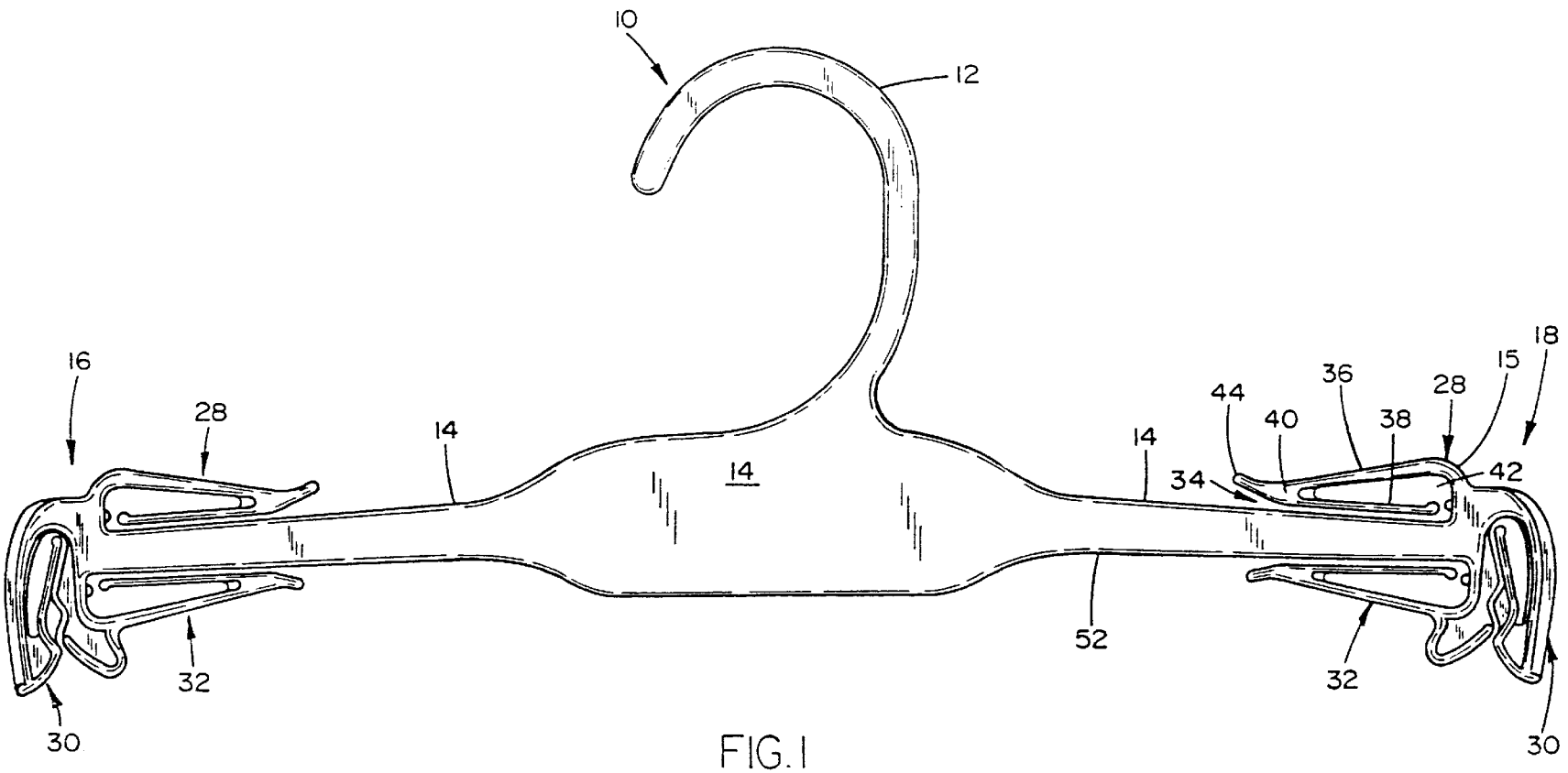
FIG. 1 is a front elevational view of a preferred embodiment of a lightweight, molded plastic garment hanger pursuant to the teachings of the present invention.
Figure 2:
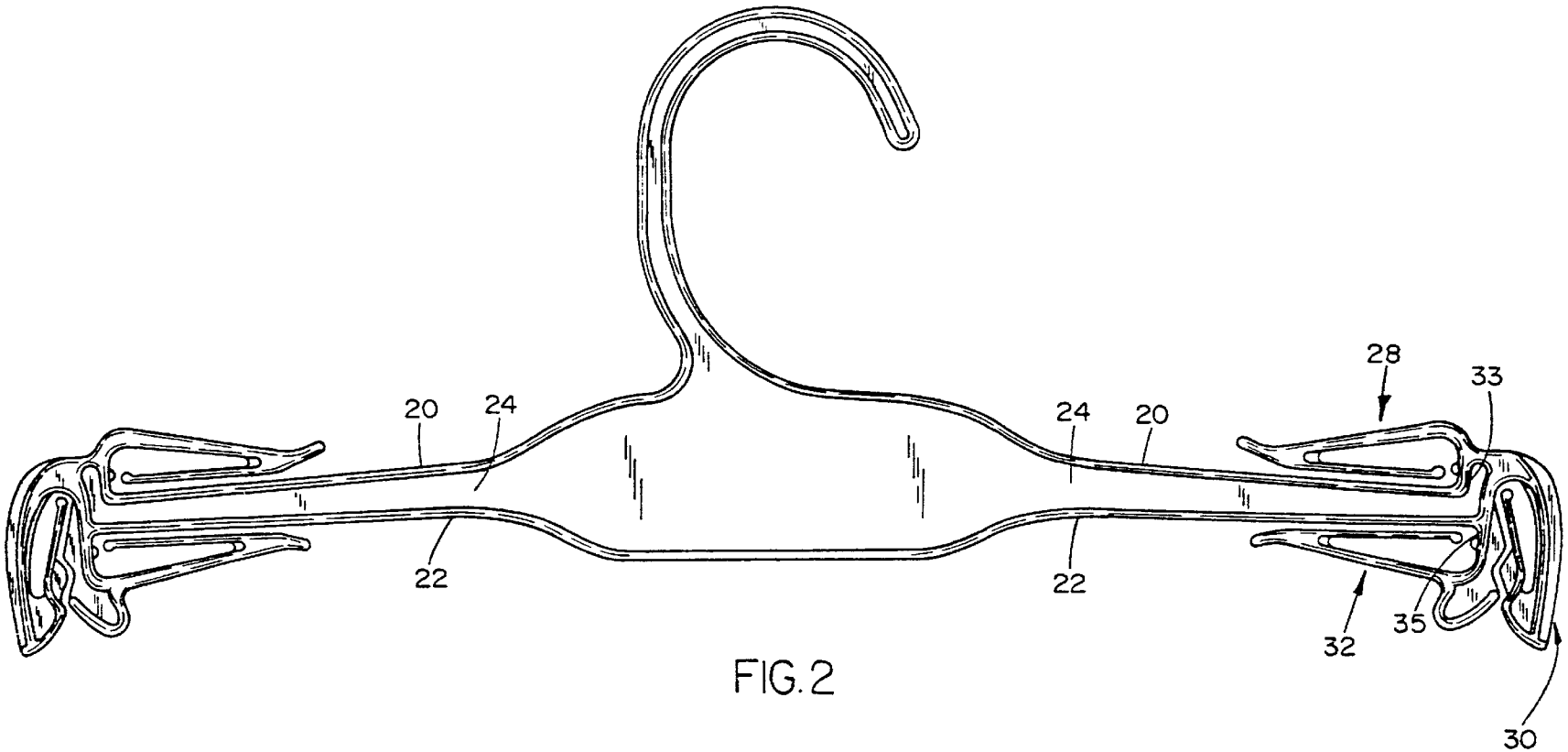
FIG. 2 is a rear elevational view of the lightweight, molded plastic garment hanger illustrated in FIG. 1.
Figure 3:
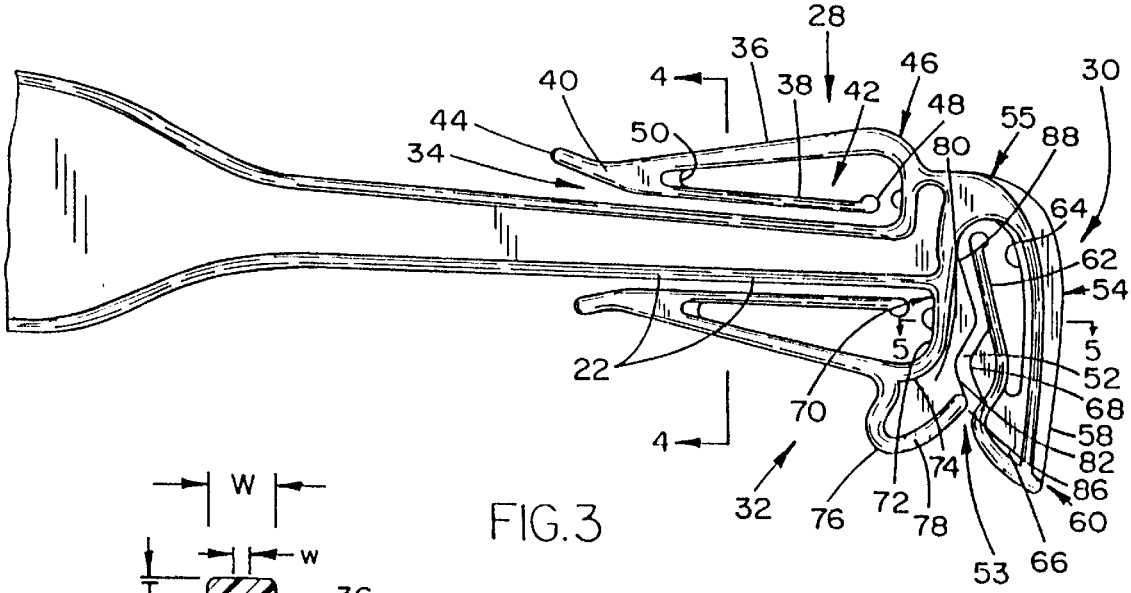
FIG. 3 is an enlarged view of one end of the lightweight, molded plastic garment hanger of FIGS. 1 and 2, illustrating further details of the novel features and construction thereof.

Referring now in detail to the drawings, FIGS. 1 and 2 illustrate respectively front and rear elevational views of a molded plastic garment hanger 10 having a central hook member 12 which is integrally molded with an elongated hanger body 14, the latter of which includes a pair of coplanar oppositely directed ends 16 and 18, with each of the ends defining a plurality of garment retaining clips for suspending one or more garments. The particular illustrated shapes of the central hook member 12 and elongated hanger body 14 are exemplary only, and can have various and different shapes and dimensions. The shaded areas in FIG. 3 are all formed with a reduced width w, reduced from the full width W, as illustrated in FIGS. 4 and 5.

Figure 4:
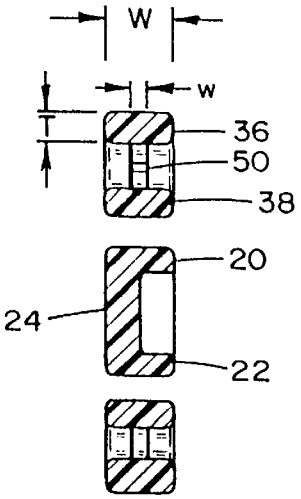
FIG. 4 is an enlarged sectional view, taken along sectional arrows 4—4 in FIG. 3, and illustrates further details of construction of the first and third garment clips of the garment hanger.
Figure 5:
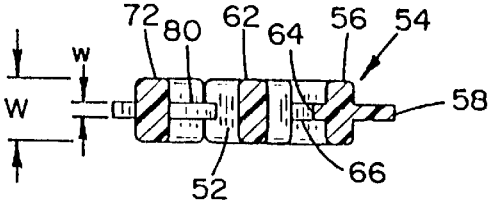
FIG. 5 is an enlarged sectional view, taken along sectional arrows 5—5 in FIG. 3, and illustrates further details of construction of the second garment clip of the garment hanger.

As depicted best in FIGS. 1, 2 and 4, to maximize strength while using the minimum amount of material, the hanger body 14 and the central hook member 12 are constructed with a C-shaped cross-section having a first horizontally extending flange 20 and a second horizontally extending flange 22 connected by a vertical wall 24. However, in alternative embodiments the hanger body 14 may be constructed with a curved M-shaped cross-section, an E-shaped cross-section, an I-beam cross-section, or any suitable cross-section which may improve the strength to weight ratio for particular applications to resist flexing due to the weight of the garment hanging from the hanger of the present invention and to assist in maintaining the hanger upright when in use.

The plurality of garment retaining clips can include one or more of a first garment retaining clip 28, a second garment retaining clip 30, and a third garment retaining clip 32. The first garment retaining clip 28 is generally horizontally disposed above the body member 14. The second garment retaining clip 30 is generally vertically disposed, with an inward slant as described in greater detail hereinbelow, and is disposed outwardly from the end 16 or 18. The third garment retaining clip 32 is generally horizontally disposed below the hanger body 14. The horizontally disposed garment retaining clips 28 and 32 typically receive shoulder straps from a brassiere, slip or like garment. The generally vertically disposed second garment retaining clip 30 typically receives a waistband from panties, swimsuit bottoms or like garments.

The hanger body 14 is constructed with a C-shaped cross-section having a generally flat central section 24 and reinforcing flanges 20, 22 extending around the edges of the central section which define the width of the garment hanger. The primary support members of the plurality of garment retaining clips 28, 30 and 32 are generally constructed of the same width W as the reinforcing flanges 32, as described in further detail hereinbelow. As illustrated in FIG. 2, the top flange 20 extends upwardly at 33 and continuously into the structure of the first garment retaining clip 28 and one side of the second garment retaining clip 30, which have the same width W as the flange 33. The bottom flange 22 extends downwardly at 35 and continuously into the structure of the third garment retaining clip 32 and the second side of the second garment retaining clip 30, which also have the same width W as the reinforcing flange.

As illustrated in FIGS. 1–3, the first garment retaining clip 28, which is positioned above and adjacent to the body member 14, defines a first garment receiving channel or mouth 34 therebetween. The first garment receiving clip 28 has a resilient substantially V-shaped, double return configuration comprising a first elongated member 36 and a second elongated member 38 integrally connected in a spaced V-shaped relationship by a connecting portion 40. When a garment is inserted into the first garment receiving channel 34, the second elongated member 38 deflects into a deflecting area 42 while it serves to hold the garment in place. The deflecting area 42 is defined by the first elongated member 36, the second elongated member 38 and the connecting portion 40. The first garment retaining clip 28 is designed and configured such that the second member 38 is moveable in a direction transverse to and from the body member 14 while resisting movement into and out of the plane of the hanger body 14. To facilitate the insertion of a garment to be suspended from the hanger, the connecting portion 40 is formed with a rounded lip 44 which extends upwardly and inwardly toward the hook member 12.

The first garment retaining clip 28, with the V-shaped members 36, 38, provides a construction having two primary resilient mounts, the first resilient mount being the cantilever mounting at 46 of the first member 36, and the second resilient mount being the cantilever mounting at 40 of member 38 relative to member 36. The construction of the first and second members 36, 38 is further illustrated in FIG. 4, which illustrates the rounded rectangular or oval shape of each of the first and second members 36, 38.

The first and second members 36, 38 are both constructed to have the same width W as the hanger body 14, which resists movement of the members 36, 38 into and out of the plane of the hanger body. This is in contrast to a prior art design in which a member similar to member 38 was constructed with a reduced width, which resulted in substantial movement of the member into and out of the plane of the hanger body. FIGS. 3 and 4 also illustrate a center stiffening rib 50 connecting the first and second members 36 and 38 near the cantilever mounting 40 which stiffens the cantilever mounting, and also resists movement of member 38 into and out of the plane of the hanger body.

Figure 6:
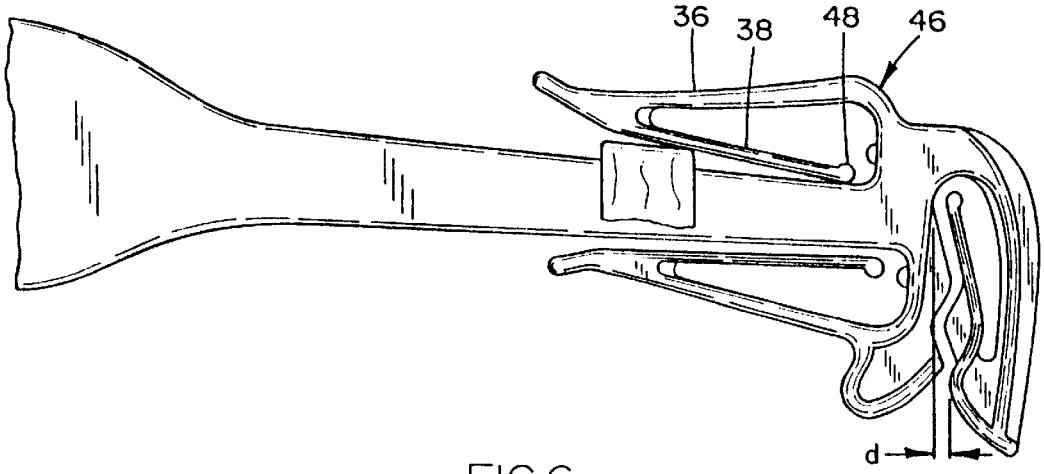
FIG. 6 is a front elevational view of the first garment clip with a garment strap being inserted into the mouth of the clip, and illustrates how the initial insertion causes the clip to deform to accept the garment strap.

The construction and design is such that as a garment or strap is initially inserted into the mouth of the first garment receiving channel 34, as illustrated in FIG. 6, an initial expansion at the mouth of the garment receiving channel caused by insertion of the garment therein causes a rotation of the combination of the first and second members 36, 38 about the first cantilever mount 46. As illustrated in FIG. 6, during the initial insertion the first member 36 bends upwardly, with the upward bend most pronounced nearer to the cantilever mounting at 46. As the garment or strap slides past the second cantilever mount 40 and towards the free end 48 of the second member 38, as illustrated in FIG. 7, it causes an upward flexure of the free end 48 of the second member 38, which also results in a downward deflection of the free end of the first member 36 at 40 and a closing of the bottom of the second member 38 near the location at 40 relative to the hanger body 14 positioned therebeneath.

Figure 7:
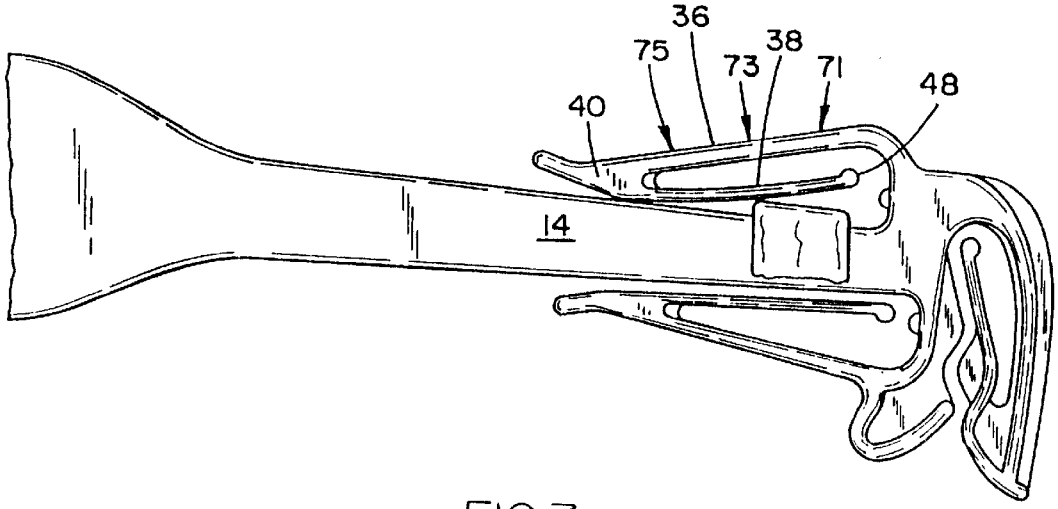
FIG. 7 is a front elevational view of the first garment clip with a garment strap fully inserted therein, and illustrates how the full insertion causes the free end of the first garment clip to close against the garment therein, thereby securely retaining the garment in the clip.
Figure 8:
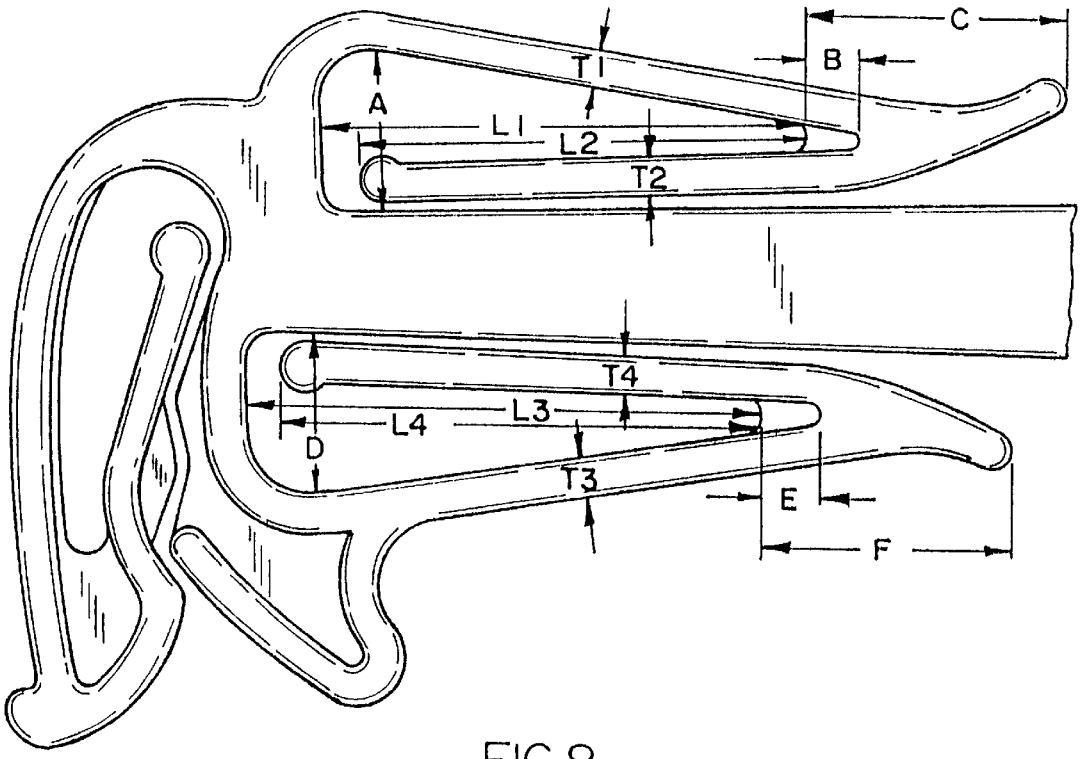
FIG. 8 is a front elevational view of the first and third garment clips, and illustrates some of the more significant dimensions of those clips.

As illustrated in FIG. 7, when the garment clip is closed upon a garment, the top member 36 frequently assumes a complex curved shape, initially bowing downwardly at 71, and then bowing up very slightly at 73, then bowing continuously downwardly at 75 towards the connecting position 40.

Accordingly, as a garment or strap is inserted into the first garment retaining clip 28, the compound mounting and action of the first and second members 36, 38 result in the mouth of the clip first opening to allow the garment to enter, and then closing to securely retain the garment or strap therein to prevent it from being accidentally dislodged and falling from the first garment retaining clip. This advantageous feature of automatic closing of the mouth of the garment retaining clip against a garment or strap after the garment or strap has been inserted therein is novel relative to known prior art garment retaining clips.

Moreover with such molded plastic garment hangers, garments are frequently inserted into the garment clips manually by a person who inserts a great number of garments into a corresponding number of garment clips. Prior art garment clips have been designed with additional strength and stiffness to prevent breakage of the garment clips as a garment is inserted therein or removed therefrom. The additional strength and stiffness has often been achieved by designing the moveable arm or arms of the garment clip with a stiffening, reinforcing outer rib extending longitudinally along the outer length of the moveable arm, similar to the reinforcing outer rib 58 of the garment clip 30 illustrated in FIGS. 3 and 5. With the stiffer, more rigid clips typical of the prior art, the persons inserting the garments into the garment clips frequently developed carpel tunnel syndrome because of the constant strain associated with inserting a large number of garments, particularly thicker garments, into the garment clips.

The present invention takes an opposite approach in which the garment clip is designed with greater flexibility, without a stiffening rib extending longitudinally along the length of the moveable clip arm. The more flexible clip arm is much easier to open and use by a customer, and moreover the greater flexibility results in almost no breakage of the clip arms. The greater flexibility is achieved by eliminating a stiffening rib, and also by designing the garment clip with a double return configuration as explained hereinabove.

The garment retaining clip of the present invention is designed to be much more flexible and easier to open and use than previous prior art designs. The more flexible design is achieved by the double return configuration and functioning of the garment clip as described hereinabove, and by a careful designing of, the garment dimensions, ratios of the dimensions, and selection of an appropriate material.

The inventive plastic hanger can be formed of styrene which provides a clear, virtually transparent polystyrene hanger for maximum display of intimate apparel garments, such as bras and panties, to be suspended therefrom. In the alternative, the hanger can be molded from polypropylene; preferably II.I, styrene polypropylene; polypropylene; polyvinychloride; ABS or other suitable thermoplastics and mixtures thereof. For additional reinforcement, K resin can be added to the plastic material.

The preferred material polystyrene has a Flexural Modulus, MPa, of 3,170, taken from CONCISE ENCYCLOPEDIA OF POLYMER SCIENCE AND ENGINEERING, p. 1117.

In one preferred embodiment, the first garment clip 28 has the following dimensions shown in the left column, which can vary in alternative embodiments between the lower and upper limits shown respectively in the middle and right columns,

| | | |
|---|---|---|
| W = 0.190" | 0.14 | 0.24 |
| $T_1 = T_2 = 0.078"$ | 0.06 | 0.10 |
| $L_1 = 0.890"$ | 0.67 | 1.11 |
| $L_2 = 0.807"$ | 0.60 | 1.01 |
| A = 0.318" | | |
| B = 0.130" | | |
| C = 0.414" | | |

The garment clip 28 has the following ratios of dimensions shown in the left column, which can vary in alternative embodiments between the lower and upper limits shown respectively in the middle and right columns.

| | | |
|---|---|---|
| W/T = 2.436 | 1.8 | 3.0 |
| $L_1/T = 11.410$ | 8.5 | 14.3 |
| $L_2/T = 10.346$ | 7.7 | 13.0 |
| $L_1/W = 4.684$ | 3.5 | 5.9 |
| $L_2/W = 4.247$ | 3.2 | 5.3 |

The third garment retaining clip 32 is constructed similar to the first garment retaining clip 28, and accordingly functions in a manner similar to that explained above for the first garment retaining clip.

The third garment clip 32 has the following dimensions, shown in the left column, which can vary in alternative embodiments between the lower and upper limits shown respectively in the middle and right columns

| | | |
|---|---|---|
| W = 0.190" | 0.14 | 0.24 |
| $T_3 = T_4 = 0.078"$ | 0.06 | 0.10 |
| $L_3 = 0.950"$ | 0.71 | 1.19 |
| $L_4 = 0.876"$ | 0.66 | 1.11 |
| D = 0.321" | | |
| E = 0.130" | | |
| F = 0.363" | | |

The third garment clip 32 has the following ratios of dimensions shown in the left column, which can vary in alternative embodiments between the lower and upper limits shown respectively in the middle and right columns

| | | |
|---|---|---|
| W/T = 2.436 | 1.8 | 3.0 |
| $L_3$/T = 12.179 | 9.1 | 15.2 |
| $L_4$/T = 11.231 | 8.4 | 14.0 |
| $L_3$/W = 5.000 | 3.8 | 6.2 |
| $L_4$/W = 4.611 | 3.5 | 5.8 |

The above dimensions and ratios have been found to provide garment clips constructed of polystyrene which are particularly efficacious and useful. However, other suitable plastic materials having a different Modulus of Elasticity (Young's Modulus) than polystyrene may be utilized in alternative embodiments with suitable modifications of the garment clip dimensions and ratios of dimensions.

Referring to FIG. 3, the second garment retaining clip 30 is integrally molded with the hanger body at each of the first and second ends. Each second garment retaining clip comprises first and second opposed clip sides defining a garment receiving channel 52 therebetween. The second garment retaining clip 30 is designed to mount panties, and includes several novel features. The V at 53 defining the mouth of the garment receiving channel 52 of the second garment retaining clip defines a larger opening than the mouths of known prior art garment retaining clips, which makes it easier to mount panties on the garment hanger. The first clip side comprises a first downwardly extending support member 54 mounted to the end of the body member by a first cantilever mount at 55 and having a spaced end. The construction of the first support member 54 of the panty holder is also novel, and provides a relatively inflexible mount for the outer rib, which provides a relatively stiff and inflexible support as a panty band is inserted into the second garment retaining clip.

The first support member 54 has a rounded rectangular shaped member 56, as illustrated in section in FIG. 5, having the same width W as the hanger body 14. Additionally, a center stiffening rib 58 extends longitudinally along the outer length of support member 54. The first support member 54 extends to a spaced end at 60 which forms a cantilever support and mount for a second support member 62. The second member 62 also has a rounded rectangular shape, as illustrated in section in FIG. 5, having the same width W as the hanger body. A center rib 64 extends longitudinally along the inner length of support member 56, and extends into a center cantilever support 66 for the second member 62. The second member 62 defines a center toothed section 68.

The second clip side comprises a downwardly extending member which is positioned opposed to and spaced from the first clip side to define the garment receiving channel 52 therebetween. The reinforcing flange 22 of the hanger body 14 extends downwardly at 70 into a support member 72, having the same width W, which extends downwardly to form the second opposed side of the second garment retaining clip. The support member 72 extends downwardly, and then inwardly at 74 where it extends into and forms a part of the third garment retaining clip 32. A support member 76, having a width W, extends downwardly from support member 72, and then curves around and extends outwardly at 78. A center rib 80 defines a center toothed section 82, spaced and opposed to the center toothed section 68, to form the garment receiving channel 52 therebetween to grasp and retain a garment therein.

A further novel feature of the second garment retaining clip is the inward slant defined by the garment receiving channel 52 of the panty retaining clip. As a panty waist band is inserted into the second garment retaining clip and is inserted from an initial position at location 86 to a fully inserted position at location 88, the panty waist band moves radially inwardly towards the center of the garment hanger a distance d, FIG. 6, of approximately ⅛ inch. This means that after a panty waist band is inserted fully into the panty retaining clip, the panty waist band shrinks approximately ⅛" at each end of the garment hanger. This also means that the panty waist band must be expanded or stretched ¼", ⅛" at each end of the garment hanger, to remove the panty from the panty retaining clip, which makes accidental removal or dislodgement of the garment from the garment clip a virtual impossibility.

A novel feature of the second garment retaining clip 30 is the reinforcing outer rib 58 which extends along the length of and reinforces the first support member 58 to make the first support member more rigid and less resilient, and also the inner reinforcing rib 64.

While several embodiments and variations of the present invention for a garment hanger are described in detail herein, it should be apparent that the disclosure and teachings of the present invention will suggest many alternative designs to those skilled in the art.

What is claimed is:

1. A lightweight, molded plastic garment hanger comprising:

a hook member;

a body member extending longitudinally from said hook member, said body member defining first and second ends;

a garment retaining clip integrally molded with said body member at each of said first and second ends, wherein each garment retaining clip is positioned adjacent to said body member and defines a garment receiving channel therebetween, said garment retaining clip having a compound movement and double arm configuration formed by a first arm member mounted to the end of the body member by a first cantilever mount and having a spaced end, and a second arm member integrally connected at an acute angle to the spaced end of the first arm member with a spaced free end suspended between said body member and said first arm member, wherein the first arm member defines a substantially rounded rectangular or oval cross section having a width W and a thickness T, wherein the ratio of W/T varies from 1.8 to 3.0, and the first member has a length L1 extending from the first cantilever mount to the acute angle, and the ratio of L1/T varies from 8.5 to 14.3, and wherein as a garment enters the garment receiving channel, an initial expansion at the garment receiving channel rotates the first and second arm members about the first cantilever mount, and as the garment slides past the acute angle, it causes an outward flexure of the free end of the second arm member away from the body member and an inward deflection of the spaced end of the first arm member towards the body member which closes the second arm member against the body member, wherein the compound action of the garment clip results in an opening of the garment receiving channel to allow the garment to enter, and then a closing to securely retain the garment therein and to prevent it from being accidentally dislodged therefrom.

2. A lightweight, plastic garment hanger as claimed in claim 1, wherein the second arm member defines a substantially rounded rectangular or oval cross section having a width W and thickness T, wherein the ratio of W/T varies from 1.8 to 3.0, and the second arm member has a length L2 extending from the acute angle to the free end of the second member, and the ratio of L2/T varies from 7.7 to 13.0.

3. A lightweight, plastic garment hanger as claimed in claim 1, wherein the width W is within the range of from 0.14 inches to 0.24 inches.

4. A lightweight, plastic garment hanger as claimed in claim 3, wherein the width W is substantially 0.190 inches.

5. A lightweight, plastic garment hanger as claimed in claim 1, wherein the thickness T is within the range of from 0.06 inches to 0.1 inches.

6. A lightweight, plastic garment hanger as claimed in claim 5, wherein the thickness T is substantially 0.078 inches.

7. A lightweight, plastic garment hanger as claimed in claim 1, wherein the length L1 is within the range of from 0.67 to 1.11 inches.

8. A lightweight, plastic garment hanger as claimed in claim 7, wherein the length L1 is substantially 0.89 inches.

9. A lightweight, plastic garment hanger as claimed in claim 1, wherein a second garment retaining clip is integrally molded with said body member at each of said first and second ends on an opposite side of said body member from said garment retaining clip, wherein each second garment retaining clip is positioned adjacent to said body member and defines a garment receiving channel therebetween, said garment retaining clip having a compound movement and double arm configuration formed by a first arm member mounted to the end of the body member by a first cantilever mount and having a spaced end, and a second arm member integrally connected at an acute angle to the spaced end of the first member said second arm member having a spaced free end suspended between said body member and said first arm member, wherein the first arm member defines a substantially rounded rectangular or oval cross section having a width W and a thickness T, wherein the ratio of W/T varies from 1.8 to 3.0, and the first arm member has a length L3 extending from the first cantilever mount to the second cantilever mount, and the ratio of L3/T varies from 9.1 to 15.2.

10. A lightweight, plastic garment hanger as claimed in claim 9, wherein the second arm member of the second garment clip defines a substantially rounded rectangular or oval cross section having a width W and thickness T, wherein the ratio of W/T varies from 1.8 to 3.0, and the second arm member of the second garment clip has a length L4 extending from the second cantilever mount to the free end of the second arm member, and the ratio of L4/T varies from 8.4 to 14.0.

11. A lightweight, plastic garment hanger as claimed in claim 9, wherein the width W of the second garment clip is within the range of from 0.14 inches to 0.24 inches.

12. A lightweight, plastic garment hanger as claimed in claim 11, wherein the width W of the second garment clip is substantially 0.190 inches.

13. A lightweight, plastic garment hanger as claimed in claim 9, wherein the thickness T of the second garment clip is within the range of from 0.06 inches to 0.1 inches.

14. A lightweight, plastic garment hanger as claimed in claim 13, wherein the thickness T of the second garment clip is substantially 0.078 inches.

15. A lightweight, plastic garment hanger as claimed in claim 9, wherein the length of L3 of the second garment clip is within the range of from 0.71 to 1.19 inches.

16. A lightweight, plastic garment hanger as claimed in claim 15, wherein the length L3 of the second garment clip is substantially 0.95 inches.

17. A lightweight, plastic garment hanger as claimed in claim 1, wherein each of the first and second arm members has the same width W as the body member to resist movement into and out of a plane defined by the body member.

18. A lightweight, plastic garment hanger as claimed in claim 1, wherein the double arm configuration of the first and second members forms a V-shaped juncture having a curved extension.

19. A lightweight, plastic garment hanger as claimed in claim 1, further including a generally vertical garment retaining clip integrally molded with said body member at each of said first and second ends, wherein each generally vertical garment retaining clip comprises first and second opposed clip sides defining a garment receiving channel therebetween, said first clip side comprising a first downwardly extending member mounted to the end of the body member by a first cantilever mount and having a spaced end, and a second upwardly extending member integrally connected to the spaced end of the first member by a second cantilever mount and having a spaced free end, said second clip side comprising a downwardly extending second clip side member which is positioned opposed to and spaced from the first clip side to define the garment receiving channel therebetween, and wherein the garment receiving channel defined by the first and second opposed clip sides proceeds from a bottom opening of the garment receiving channel, upwardly and inwardly towards the hook member to a top garment retaining position, wherein the radial difference alone the axis of the hanger body between the bottom opening and the top garment retaining position is approximately 0.125 inches, which deters accidental dislodgement of the garment secured by said generally vertical clip.

20. A lightweight, plastic garment hanger as claimed in claim 19, wherein the first downwardly extending member of the first clip side includes a center stiffening rib extending longitudinally along the outer length of the first downwardly extending member to provide a relatively stiff and inflexible first downwardly extending member.

21. A lightweight, plastic garment hanger as claimed in claim 20, wherein the first downwardly extending member of the first clip side further includes a center stiffening rib extending longitudinally along the inner length of the first downwardly extending member to provide a relatively stiff and inflexible first downwardly extending member.

22. A garment hanger having a molded double action garment retaining clip having improved flexibility and range of motion, said clip integrally molded on a polystyrene plastic garment hanger, said hanger having a hook and a body member extending longitudinally from said hook to define first and second ends on either side of said hook, said clip comprising:

(a) a cantilever mount for securing said garment retaining clip to said body member, and suspending said retaining clip at a defined distance from said body member;

(b) a first flexible clip member mounted on said cantilever mount, said first flexible clip member extending inwardly in the direction of said hook and having a first end and a second end, said first end molded to said cantilever mount, and said second end extending inwardly in the direction of said hook, said first clip flexible member having a width to thickness ratio of 1.8 to 3.0 and a length to thickness ratio of 8.5 to 14.3;

(c) a second flexible clip member formed on said inwardly extending first flexible clip member at an acute angle thereto, said second flexible clip member having a first and a second end, said first end of said second flexible clip member integrally molded to the second end of said first flexible clip member, the second end of said second flexible clip member extending outwardly from said hook and positioned adjacent said hanger body to form a garment retention area, said second flexible clip member having a width to thickness ratio of 1.8 to 3.0 and a length to thickness ratio of 7.7 to 13.0;

(d) the juncture of said first flexible clip member and said second flexible clip member defining, in cooperation with the hanger body member, an insert guide for guiding a garment strap into said garment retention area wherein said second flexible clip member is generally parallel to said body member prior to the insertion of a garment therebetween.

23. A garment hanger having a molded double action garment retaining clip having improved flexibility and range of motion as claimed in claim 22, wherein the juncture of said second end of said first clip member and the first end of said second clip member form an acute V-shaped juncture, with an extension of the V-shaped juncture having an upward curve oriented towards said hook to assist in guiding a garment into a garment receiving channel formed between said clip and said body member.

24. A garment hanger having a molded double action garment retaining clip having improved flexibility and range of motion as claimed in claim 23, wherein an initial expansion at the garment receiving channel at said V-shaped juncture by an entering garment, rotates the first and second flexible clip members with respect to the first cantilever mount, and as the garment slides past the V-shaped juncture, the garment causes a flexure of the second end of the second flexible clip member away from the body member and wherein continued movement of the garment causes an inward deflection of the second end of the first flexible clip member towards the body member which closes the V-shaped juncture against the body member, whereby the compound action of the garment retaining clip results in the opening of the garment receiving channel to allow the garment to enter, and then the closing thereof to securely retain the garment therein and to prevent the garment from being accidentally dislodged therefrom.

25. A garment hanger having a molded double action garment retaining clip having improved flexibility and range of motion as claimed in claim 23, wherein the first flexible clip member defines a substantially rounded rectangular or oval cross section having a width W and a thickness T, wherein the ratio of W/T varies from 1.8 to 3.0, said first flexible clip member having a length L1 extending from the first cantilever mount to the V-shaped juncture, and the ratio of L1/T varies from 8.5 to 14.3.

26. A garment hanger having a molded double action garment retaining clip having improved flexibility and range of motion as claimed in claim 24, wherein the first flexible clip member defines a substantially rounded rectangular or oval cross section having a width W and a thickness T, wherein the ratio of W/T varies from 1.8 to 3.0, said first flexible clip member having a length L1 extending from the first cantilever mount to the V-shaped juncture, and the ratio of L1/T varies from 8.5 to 14.3.

27. A garment hanger having a molded double action garment retaining clip having improved flexibility and range of motion as claimed in claim 26, wherein the second flexible clip member defines a substantially rounded rectangular or oval cross section having a width W and thickness T, wherein the ratio of W/T varies from 1.8 to 3.0, and the second flexible clip member has a length L2 extending from the V-shaped juncture to the second end of the second clip member, and the ratio of L2/T varies from 7.7 to 13.0.

28. A garment hanger having a molded double action garment retaining clip having improved flexibility and range of motion as claimed in claim 25 or 26 or 27, wherein the width W is within the range of from 0.14 inches to 0.24 inches.

29. A garment hanger having a molded double action garment retaining clip having improved flexibility and range of motion as claimed in claim 28, wherein the width W is substantially 0.190 inches.

30. A garment hanger having a molded double action garment retaining clip having improved flexibility and range of motion as claimed in claim 25 or 26 or 27, wherein the thickness T is within the range of from 0.06 inches to 0.1 inches.

31. A garment hanger having a molded double action garment retaining clip having improved flexibility and range of motion as claimed in claim 30, wherein the thickness T is substantially 0.078 inches.

32. A garment hanger having a molded double action garment retaining clip having improved flexibility and range of motion as claimed in claim 25 or 26 or 27, wherein the length L1 is within the range of from 0.67 to 1.11 inches.

33. A garment hanger having a molded double action garment retaining clip having improved flexibility and range of motion as claimed in claim 32, wherein the length L1 is substantially 0.89 inches.

34. A garment hanger having at least two molded double action garment retaining clips having improved flexibility and range of motion as claimed in claim 26 or 27, wherein each of said at least two garment retaining clips have acute v-shaped junctures that are rigid, with one of said at least two garment retaining clips being integrally molded with said body member at each end of said body member.

35. A garment hanger having a molded double action garment retaining clip having improved flexibility and range of motion as claimed in claim 34, wherein two garment retaining clips are integrally molded with said body member at each end of, and on opposite sides of said body member.

36. A garment hanger having a molded double action garment retaining clip having improved flexibility and range of motion as claimed in claim 34, which further includes a generally vertical garment retaining clip integrally molded at each of said first and second ends of said body member, wherein each generally vertical garment retaining clip comprises first and second opposed clip sides defining a garment receiving channel therebetween, said garment receiving channel angled upwardly and inwardly with respect to said body member.

37. A garment hanger having a molded double action garment retaining clip having improved flexibility and range of motion as claimed in claim 36, wherein said generally vertical clip further comprises a first downwardly extending member mounted to the end of the body member by a first cantilever mount and having a spaced end, and a second upwardly extending member integrally and rigidly connected to the spaced end of the first member, said second upwardly extending member having a spaced free end which is positioned opposed to and spaced from the first clip side to define the garment receiving channel therebetween, and wherein each of the garment receiving channel defined by the first and second opposed clip sides proceeds from a bottom opening of the garment receiving channel, upwardly and inwardly towards the hook member to a top garment retaining position, wherein the difference between the bottom opening and the top garment retaining position along the axis of the hanger body is approximately 0.125 inches.

38. A garment hanger having a molded double action garment retaining clip having improved flexibility and range of motion as claimed in claim 37, wherein the first downwardly extending member of the first clip side includes a center stiffening rib extending longitudinally along an outer length of the first downwardly extending member to provide a relatively stiff and inflexible first downwardly extending member.

39. A garment hanger having a molded double action garment retaining clip having improved flexibility and range of motion as claimed in claim 38, wherein the first downwardly extending member of the first clip side further includes a center stiffening rib extending longitudinally along an inner length of the first downwardly extending member to provide a relatively stiff and inflexible first downwardly extending member.

* * * * *